United States Patent [19]

Sebelle

[11] Patent Number: 4,603,855

[45] Date of Patent: Aug. 5, 1986

[54] VARIABLE EXERCISE APPARATUS

[76] Inventor: Leslie W. Sebelle, P.O. Box 1661, Honolulu, Hi. 96806

[21] Appl. No.: 222,164

[22] Filed: Jan. 2, 1981

[51] Int. Cl.[4] ..... A63B 21/00

[52] U.S. Cl. ..... 272/117; 272/118; 272/134; 272/DIG. 4

[58] Field of Search ..... 272/117, 118, 134, 136, 272/140, 143, DIG. 4, 123

[56] References Cited

U.S. PATENT DOCUMENTS

| | | | |
|---|---|---|---|
| 372,272 | 10/1887 | Murphy | 272/118 |
| 403,703 | 5/1889 | Small | 272/118 |
| 723,625 | 3/1903 | Thornley | 272/118 |
| 776,824 | 12/1904 | Bryon | 272/118 |
| 2,362,111 | 11/1944 | Burns | 272/144 |
| 3,290,044 | 12/1966 | Krodsen et al. | 272/123 X |
| 3,306,611 | 2/1967 | Gaul | 272/118 |
| 3,708,167 | 1/1973 | Potgieter | 272/134 X |
| 3,912,261 | 10/1975 | Lambert | 272/118 |
| 4,046,373 | 9/1977 | Kim | 272/144 X |
| 4,257,590 | 3/1981 | Sullivan et al. | 272/117 |

*Primary Examiner*—Richard J. Apley
*Assistant Examiner*—Robert Bahr
*Attorney, Agent, or Firm*—Schapp and Hatch

[57] ABSTRACT

An exercise apparatus having cables pullable against varying resistance along one or more horizontal arms adjustable as to height, length and as to the angle of the arms to each other and to the frame of the apparatus, the arms being telescoping for positioning the distal ends of the arms at any desired position in the volumetric area defined by semi-cylindrical surfaces, representing the swinging of the arms through their possible arcs at their fully extended and retracted positions, and extending for the total vertical height in which the arms are capable of being positioned. A takeup device provides for cable adjustment, and various weights provide adjustable resistance. A cable spool having a spiral conical groove is mounted on a shaft with a constant diameter spool for providing increasing resistance as the cable is pulled from the arms by the user.

34 Claims, 6 Drawing Figures

VARIABLE EXERCISE APPARATUS

BACKGROUND OF THE INVENTION

1. Field of the Invention

The present invention relates to Exercise Apparatus, and more particularly to apparatus in which cables are drawn from the apparatus against controlled resistance, and in which the apparatus may be adjusted to accommodate different postures of the user's body for accomplishing different types of exercise.

2. Description of the Prior Art

It has previously been known to exercise the human body by pulling cables from an exercise machine against resistance. Such resistance is usually provided by braking devices, which impose frictional resistance on the cable or rope, or by weights utilizing the force of gravity.

Various exercises may best be accomplished by having the cable issue from the apparatus at various heights, depending on the nature of the specific exercise and the build of the person using the apparatus. Early devices typically used a plurality of cables issuing from the machine over pulleys at various heights. Examples of this approach are found in U.S. Pat. Nos. 931,699 to Medart and 1,052,962 to Reach.

The number of height positions were limited by the number of cables, and the apparatus quickly became too cumbersome and complex as cables were added. To provide more vertical positions with a single cable, the art turned to mounting the egress pulley on a carriage movable vertically on the frame of the apparatus to various selected positions. Such devices are exemplified in U.S. Pat. Nos. 3,438,627 and 3,647,209, both to Jack La Lanne.

Vertical adjustment of the height of the exit pulley naturally changed the "run" of the cables, which normally were entrained over pulleys at the top and bottom of the apparatus frame. To accommodate this, prior devices typically used a "sheeting" pulley which could be moved vertically to take up slack or provide additional cable in accordance with requirements imposed by vertical positioning of the carriage. This further complicated the structure and imposed an additional hazard in the form of the vertically movable pulley. Typical of these devices is the structure disclosed in U.S. Pat. No. 3,815,903 to Fack.

French Pat. No. 1.140.902 to Charpin discloses an exercise apparatus having a vertically positionable carriage and a drum device on the carriage upon which is wound the end of the cable opposite the operating handle. The drum may be secured against rotation to the carriage at desired rotative positions of the drum for taking in or letting out slack on the cable. Charpin's French Pat. No. 1.003.973 shows an exercise apparatus having a pair of cables for pulling by both hands of the user, but the exit pulleys for the cables are not positionable.

It was found to be desirable to provide varying resistance to pulling of the cable, and the prior apparatus devices utilized several schemes to afford the variable resistance. One such device, utilizing eccentric pulleys to produce varying lever arms as the cable is pulled is shown in U.S. Pat. No. 3,640,527 to Proctor, and a similar device, but with the pulleys non-circular to produce a camming action is set forth in U.S. Pat. No. 3,912,261 to Lambert. Another approach, using a camon-lever action is shown in U.S. Pat. No. 3,905,599 to Mazman.

SUMMARY OF THE INVENTION

The present invention contemplates a variable resistance exercise apparatus possessing all of the advantages of the recited prior devices, together with further advantages and features not heretofore obtainable.

In addition to providing for vertical positioning of cable height, the present apparatus also provides for lateral positioning of the cable egress. This feature is combined with the use of two laterally spaced matching cables to afford positions and exercises not previously available. The cables and their exit pulleys are carried by arms swingable through horizontal arcs so that the cable ends of the arms may be positioned at any desired lateral spacing with respect to each other and to the centerline of the machine.

In order to expand the versatility of the present apparatus further, the swingable arms telescope so they can be extended and retracted to provide additional positions for the cable ends of the arms. In fact, the cable ends may be positioned anywhere within the volumetric areas defined by the arcs described by the cable ends in the fully extended and fully retracted conditions of the arms and the upper and lower limits of the vertical traverse of the arms on their carriages.

The present device also provides an improved cable system for each of the arms. This system utilizes three different cables. This makes it possible to interpose a means for adjusting cable length in the cable system. The cable passing from the operating handle along the arm is wound on a drum rotatably mounted on a jackshaft, to which a second drum is secured. The second drum carries the end portion of a second cable leading to the variable resistance device.

The first drum is selectively securable for joint rotation with the jackshaft by a normally engaged sprag clutch, which can be released for effecting relative rotation between the first and second drums and consequent lengthening or shortening of the effective cable length. The drums and clutch are concealed within the housing of the carriage so as to reduce risk to the user.

The present invention utilizes the force of gravity to oppose the pulling out of the cables from the arms. A plurality of weights are selectively securable in stacked relation to the ends of the cable means remote from the arms for providing the desired degree of overall resistance to such pulling out.

Variation of the resistance to pulling out is accomplished in the present device by interposing a second jackshaft between the second cable, leading from the cable length adjustment means, and the third cable leading to the stacked weights. The end of the second cable remote from the length adjustment means is wound on a spool secured to the second jackshaft, and the end of the third cable remote from the weights is wound on a spiral grooved conical drum also secured to the second jackshaft.

The spiral configuration of the groove provides for desired steadily increasing or decreasing effective diameter and corresponding lever arm effect on the third cable, thus effectively decreasing or increasing the amount of effort required to pull out the cable as more of the cable is pulled out.

An adjustable bench is provided to further facilitate performance of a wide variety of exercises on the device, and the frame is made foldable for compactness and ease of storage when not in use.

It will therefore be seen that the variable resistance and variable position dual arm exercise apparatus of the present invention has as a principal object its adaptability to a wide variety of exercises.

Another object of the invention is to provide an exercise apparatus of the character described in which both arms or both legs may be exercised at the same time and with the body of the user in a variety of positions.

A further object of the invention is to provide an exercise machine of the character set forth in which the points at which the cables emanate from the machine are both vertically and horizontally adjustable to a large number of locations.

A still further object of the present invention is the provision of an exercise device of the character described having a simple and sturdy concealed provision for adjusting the effective length of the cables in accordance with the positioning of the cables and the nature of the exercise to be performed.

Yet another object of the invention is to provide, in an exercise apparatus of the pull cable type, for an improved variable resistance device affording desired increasing or decreasing resistance to pulling out of the cable in accordance with the distance the cable has already been pulled.

For a fuller understanding of the nature and further objects and features of advantage of the present invention, reference should be had to the following detailed description, taken in connection with the accompanying drawings and the appended claims.

Figure 1:
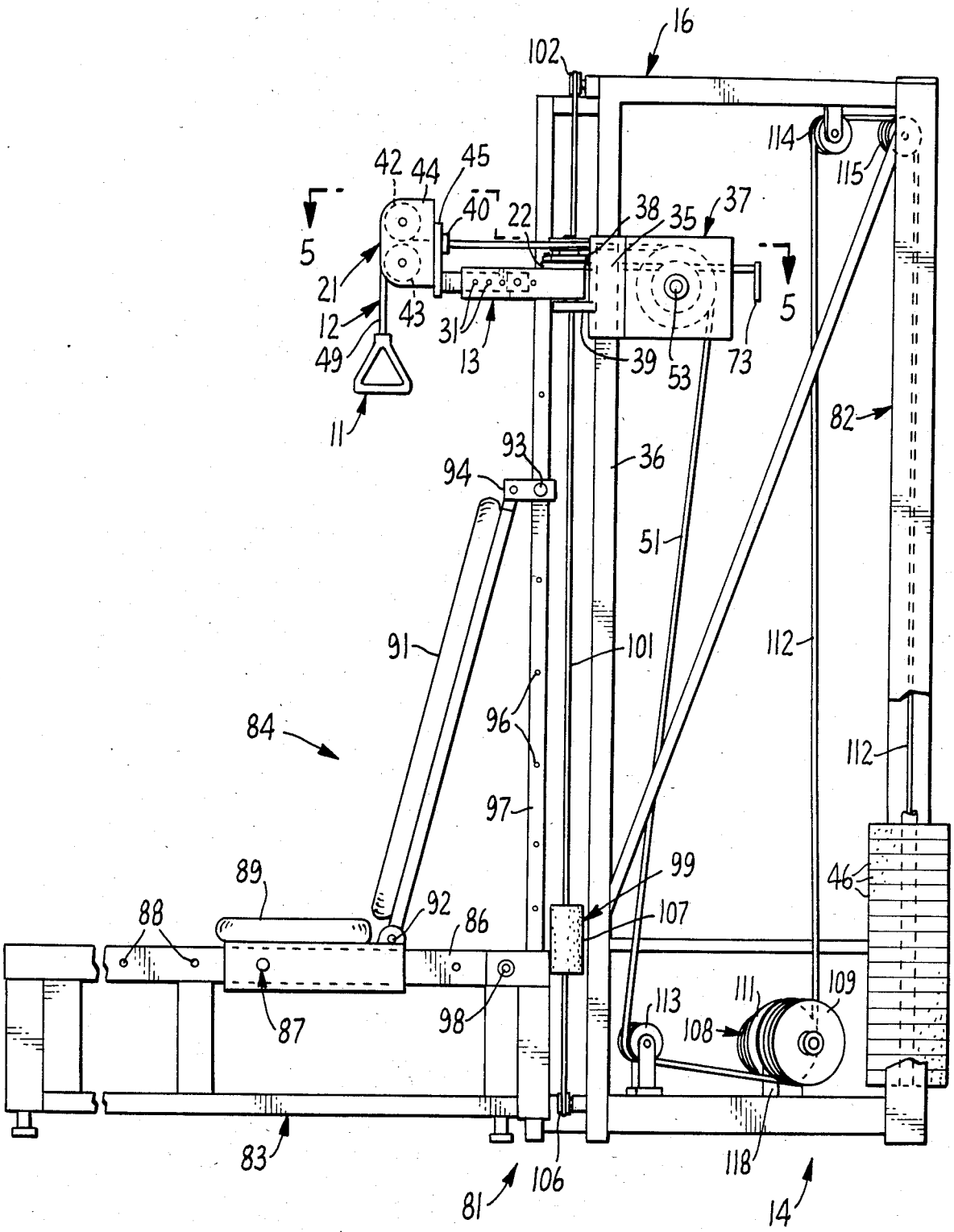
FIG. 1 is a side elevational view of an exercise apparatus constructed in accordance with the present invention and having portions broken away to conserve space.

While only the preferred embodiment of the invention has been illustrated in the drawings, it will be apparent as the specification progresses that modifications could be made to the illustrated structure within the ambit of the claims.

DESCRIPTION OF THE PREFERRED EMBODIMENTS

Referring now to the drawings in detail, it will be seen that the variable exercise apparatus of the present invention includes manually engageable handle means 11 connected to cable means 12 supported by arm means 13 in such manner that pulling on the handle means 11 draws cable from the arm means, together with resistance means 14 operatively connected to the cable means 12 and formed for resisting pulling of the cable means from the arm means 13, and support means 16 carrying the arm means 13 for relative movement for adjusting the position of the cable means 12 and handle means 11 relative to the support means 16.

In accordance with the present invention, the arm means 13 is movable both vertically and laterally so as to provide a number of positions of the cable means 12 as it exits the exercise machine. The arm means 13 is securable in the desired positions by locking means 17 so that, once the desired position of the cable means 12 is obtained, the arm means remains locked in place until it is desired to adjust the arm means to another position.

As hereshown, the arm means 13 has one end 18 pivoted on the support means 16 for swinging angular displacement of the distal end 19 of the arm means to desired positions, the locking means 17 releasably securing the arm means 13 against further angular displacement. Exit pulley means 21 for supporting the cable means 12 is carried on distal end 19 of the arm means 13, and positioning of the exit pulley means 21 controls the location of the cable means 12 thereat.

As here shown, the locking means 17 includes a first member in the form of a disc 22 secured to the arm means 13 for movement therewith and having a plurality of circumferentially spaced openings 23 around the center of pivot 24 of the arm means, and a second member 25 secured to the support means 16 and having an opening selectively registerable with the openings 23, and a removable pin 26 engageable in the registered openings.

In accordance with the present invention, to increase the number and range of lateral positions for the exit pulley 21, the arm means 13 is extendable and retractable so as to position the pulley 21 closer to or further from the pivot 24. The arm means 13 is here made extendable and retractable by forming telescoping sections 27 and 28, section 28 being secured to disc 22 and pivoted on bolt 24, while section 27 is slidable into and out of section 28 and carries the exit pulley means 21 at its outer end. Preferably, the telescoping sections are of non-circular cross-section, and means 29 is provided for selectively locking the telescoping sections 27 and 28 in the desired extended and retracted positions.

Means 29 here includes a plurality of openings 31 drilled transversely through section 28 in longitudinally spaced relation therealong, and a corresponding opening 32 drilled transversely through section 27 near the end opposite the exit pulley means 21. As section 27 is slid in and out of section 28, openings 31 and 32 become aligned, and the sections 27 and 28 are held against relative movement at the desired extension by inserting a removable pin 33 in the aligned openings.

As pointed out above, the arm means 13 is movable vertically on the support means 16 for selective adjustment of the height of the arm means. Height control means 34 is provided for releasably securing the arm means 13 at desired heights along the support means 16.

Preferably, and as here shown, the support means 16 is formed with an upright stanchion 36, and the arm means 13 is mounted on a carriage 37 movable vertically along the stanchion 36.

Figure 5:
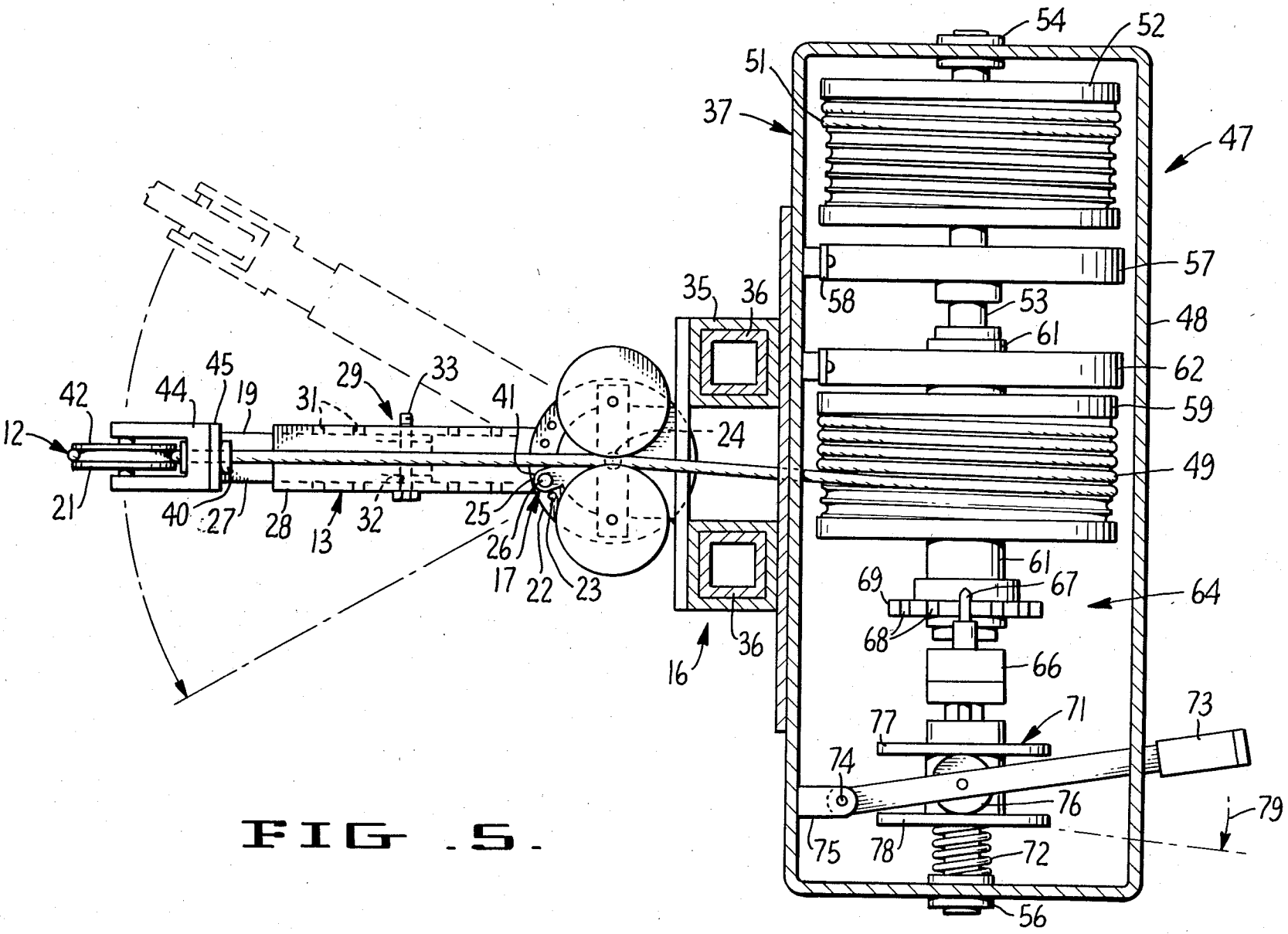
FIG. 5 is a plan sectional view of an enlarged scale taken substantially on the plane of line 5—5 of FIG. 1.
Figure 6:
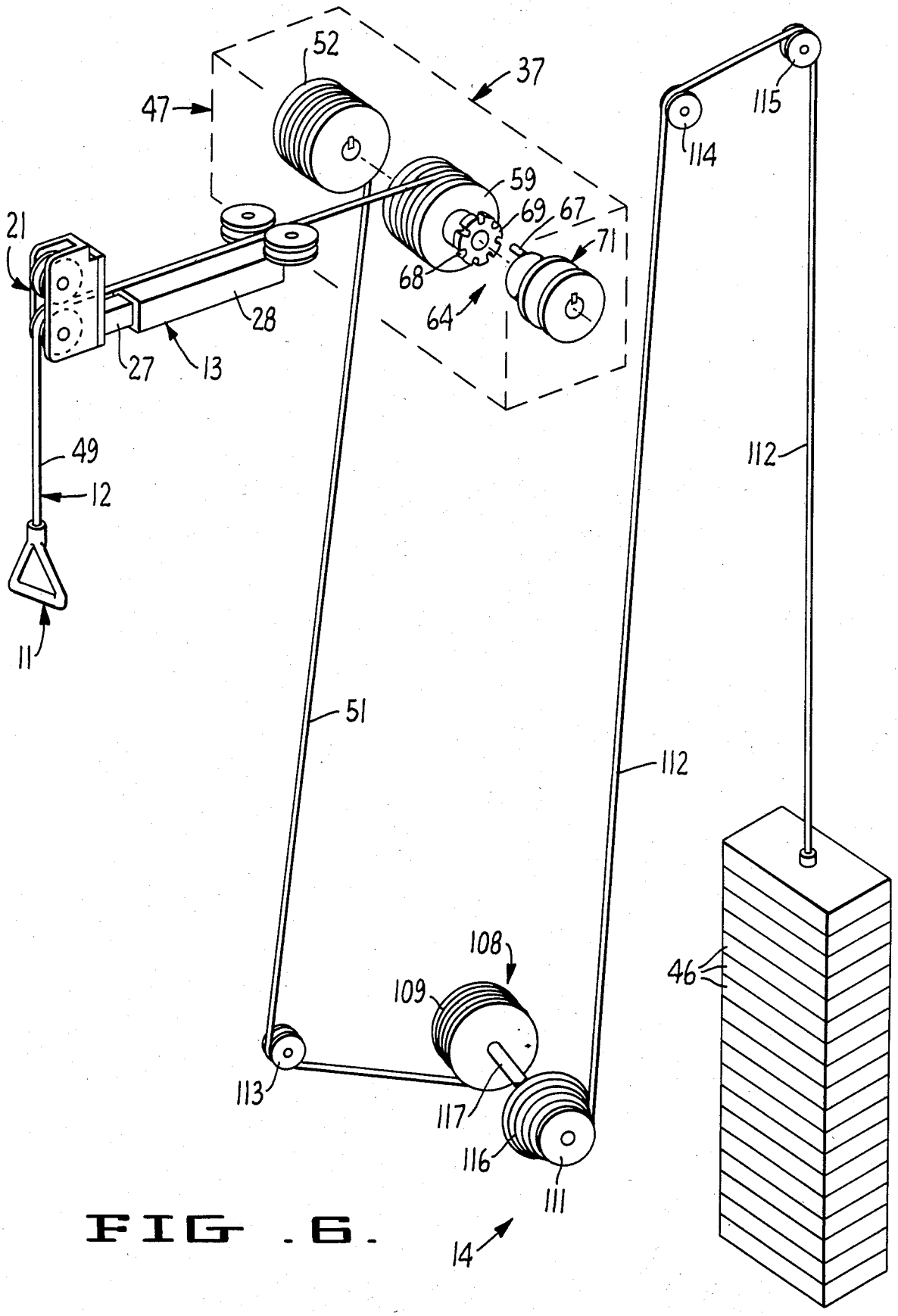
FIG. 6 is a perspective schematic view of a cable system forming part of the apparatus illustrated in FIGS. 1 through 5 of the drawings.

As may best be seen in FIGS. 1 and 5 of the drawings, carriage 37 is in the form of a rectangular box-shaped housing, having a forwardly extending portion 35 slidably receiving the stanchion 36 and supporting forwardly extending flanges 38 and 39. Pivot bolt 24 is engaged through suitable openings in flanges 38 and 39 to support the arm means 13 for the described swinging angular displacement of the distal end of the arm means 13 to the desired positions. Pin 26 is removably secured through an opening in a boss 41 secured to and extending horizontally from the upper flange 38 of the carriage 37 and registering ones of the openings 23 formed in the disc 22 secured to the arm means 13.

The exit pulley means 21 is preferably in the form of upper and lower complementary pulleys 42 and 43 journalled in edge to edge relation in a C-shaped member 44 pivotally attached to the outer end of arm section 27 for rotation about a horizontal axis. Member 44 is journalled on a short tube 40 secured to a vertical plate 45 mounted on the distal end of arm section 27 and cable means 12 passes longitudinally through tube 40.

As an important feature of the present invention, the arm means 13 and associated carriages 37 may be provided in pairs so that both arms and/or both legs may be exercised simultaneously. This greatly increases the versatility of the exercise machine and is made practicable by the design of the cable systems. As here shown, the arm means 13 comprises a pair of arms 13A and 13B carried on the support means 16 in horizontally spaced relation, see FIGS. 2 and 3.

Each of the arms 13A and 13B has one end pivoted on the support means in the manner heretofore described for independent angular displacement of the distal ends of the arms to desired positions. Both arms are also telescoping in the manner described and are provided with vertically movable carriages 37A and 37B so that their exit pulley means 21A and 21B may be positioned anywhere within the volumetric area between concentric cylindrical sections defined by the arcs described by the distal ends of the arm means 13A and 13B when swung from side to side with the arm means in fully extended and fully retracted conditions and at all heights of the carriages 37A and 37B along the stanchions 36.

Resistance means 14 is formed to provide separately adjustable resistance to pulling of the cable means 12 from each of the arms 13A and 13B, the resistance means comprising weights resisting the pulling of the cable means from the arms in accordance with the influence of gravity. The resistance means for each of the arms 13A and 13B here includes a stack of individual weights 46 which may be selectively connected together by any of a number of known conventional means to provide the amount of weight desired for the particular exercise.

As the carriages 37A and 37B are moved upwardly or downwardly on stanchions 36 to provide the desired height for exit pulleys 2LA and 21B, the effective length of the cable means 12 changes. To accommodate this change, cable length adjustment means 47 is mounted on each of the carriages 37A and 37B. A typical detail of the carriages 37 and associated cable length adjustment means 47 may be seen in FIG. 5 of the drawings. As thereshown, carriage 37 includes a housing 48 of rectangular, box-like configuration, preferably enclosing the cable length adjustment means 47 as a safety precaution.

Cable length adjustment means 47 is formed for readjusting the effective length of the cable means 12 upon vertical movement of the arm means and carriage whereby the handle means 11 is maintained at a normal position a desired distance from the exit pulleys 21. For this purpose, the cable length adjustment means 47 is interposed in the cable system between the cable 49 leading to the handle means 11 and a second cable 51 leading eventually to the weights 46.

Cable 51 is wound on a drum 52 affixed for joint rotation to a jackshaft 53 journalled at 54 and 56 to the housing 48. A spiral spring 57 has its internal end (not shown) secured to jackshaft 53 and its outer end 58 secured to the housing 48, spring 57 being biased to tend to cause cable 51 to be wound onto drum 52.

Cable 49 has its end opposite to handle means 11 wound onto a drum 59 having a hub 61 journalled on jackshaft 53. A spiral spring 62 has its inner end connected to hub 61 and its outer end 63 secured to housing 48, spring 62 being biased to tend to cause cable 49 to be wound onto drum 59.

Clutch means 64 is provided for selectively securing drum 59 to jackshaft 53 for joint rotation so that, as cable 49 is pulled from drum 59, cable 51 is correspondingly wound onto drum 52 against the gravitational resistance to lifting of weights 46.

As here shown, clutch means 64 is of the sprag type, having a collar 66 splined onto jackshaft 53 and carrying a clutch member 67 movable axially of jackshaft 53 into and out of engagement with notches 68 formed in the periphery of a disc member 69 secured for joint rotation to hub 61. Thus, when member 67 is engaged in one of the notches 68, as illustrated in FIG. 5 of the drawings, drum 59 is constrained to rotate with jackshaft 53 and drum 52. When member 67 is withdrawn from the notches 68, drum 59 becomes freewheeling and the effective length of the cable system can be adjusted by relative rotation of drums 52 and 59.

The described axially movement of member 66 and clutch member 67 is here accomplished by a spool 71 axially slidable on jackshaft 53 and connected member 66. A coil compression spring 72 encircles jackshaft 53 between spool 71 and bearing 56, spring 72 serving to urge clutch 64 into engaged condition. A manually operable handle 73 is pivoted at 74 to an ear 75 secured to housing 48 and has a roller 76 engaged between parallel flanges 77 and 78 of spool 71 so that, when handle 73 is moved in the direction indicated by arrow 79, clutch member 67 will be disengaged from the notches 68.

Figure 2:
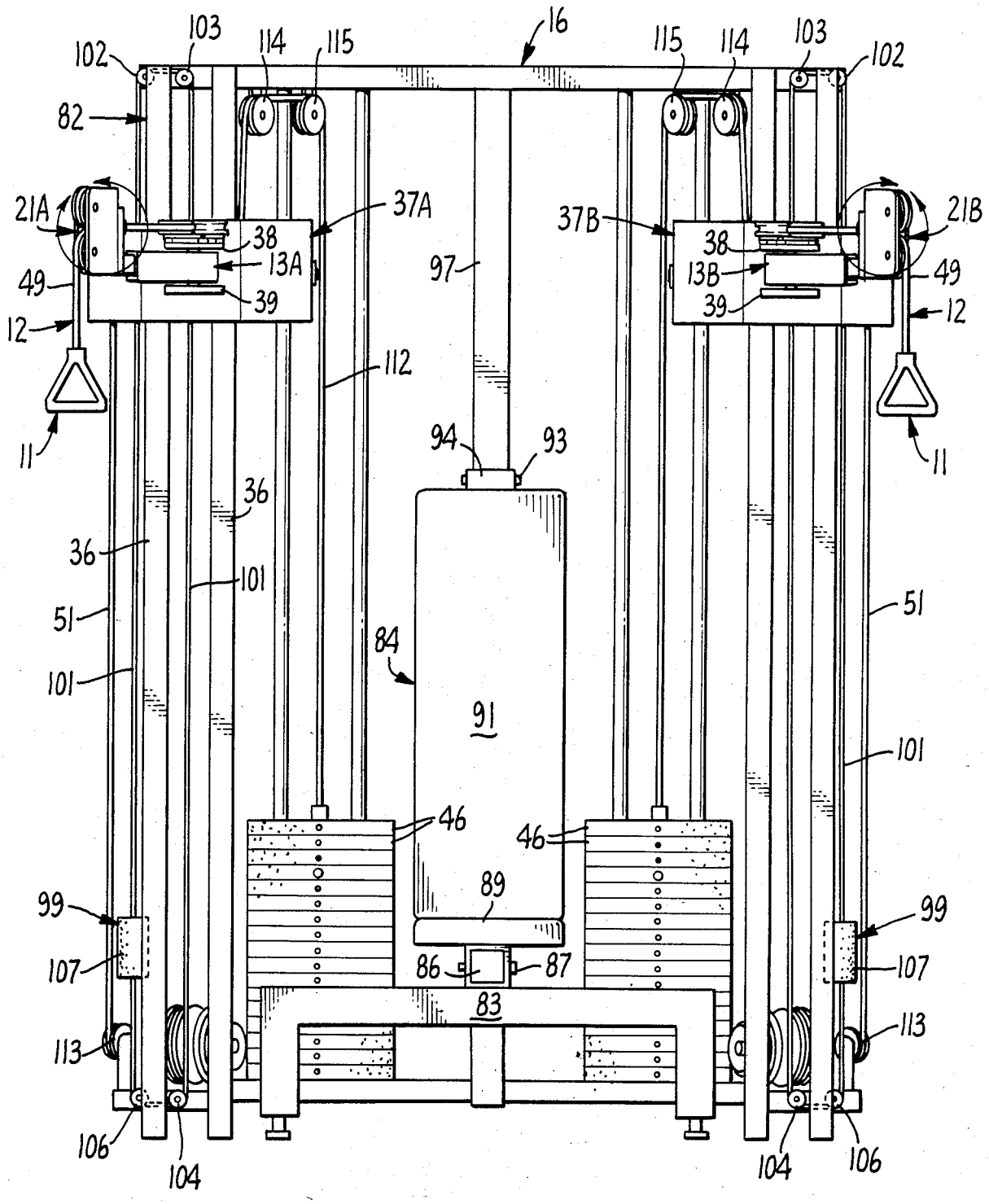
FIG. 2 is a front elevational view of the apparatus of FIG. 1.
Figures 3, 4:
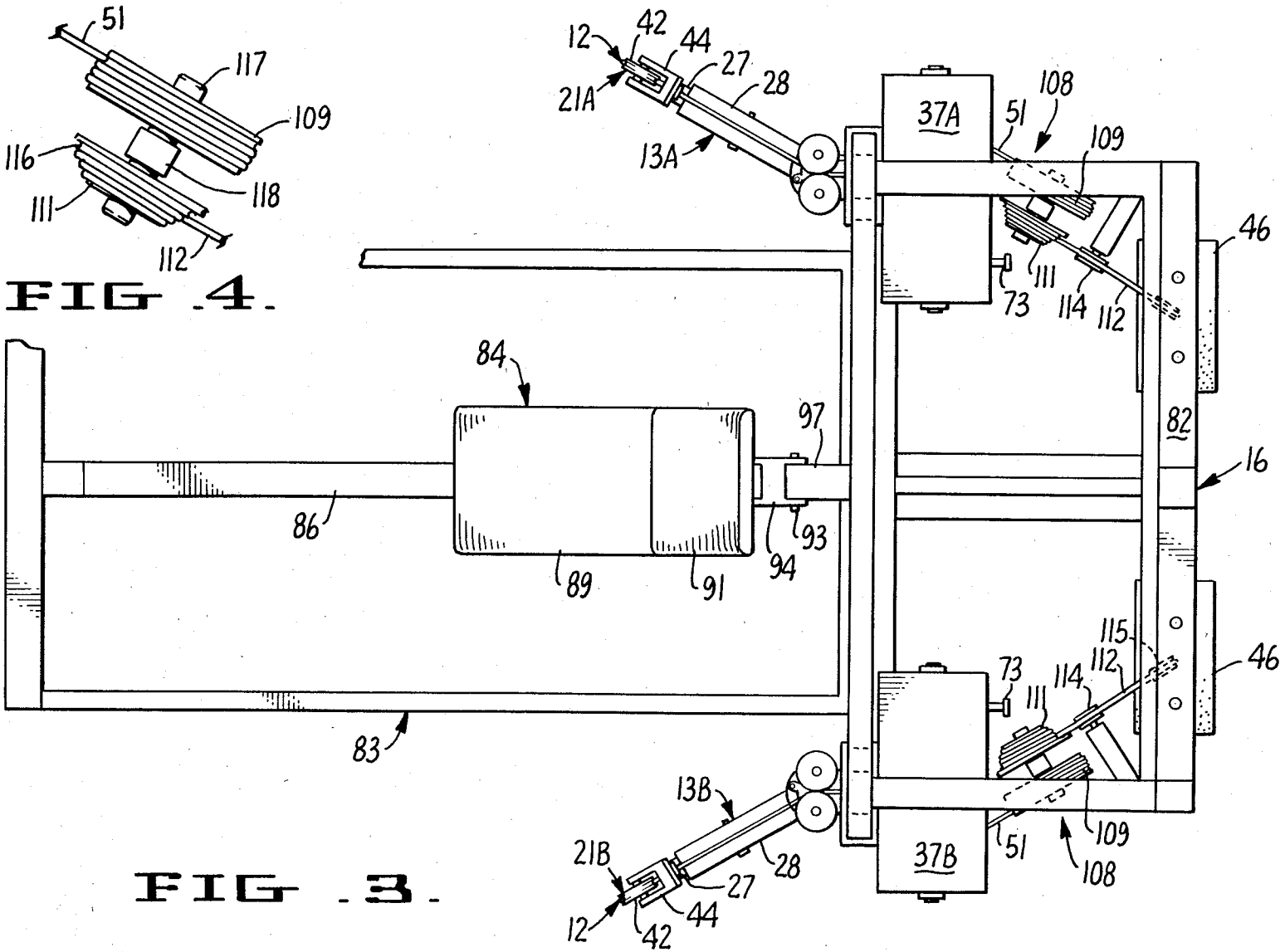
FIG. 3 is a plan view of the apparatus of FIG. 1.
FIG. 4 is a plan view of a variable resistance device constructed in accordance with the present invention.

As may best be seen in FIGS. 1 through 3 of the drawings, the variable exercise apparatus of the present invention includes a supporting frame 81 having a vertically extending section 82 and a horizontally extending section 83. The above-described arm means 13 and their associated carriages 37 are supported by and are vertically movable along stanchions 36 forming part of the vertically extending frame section 82. A body support 84 is mounted on the horizontally extending frame section 83 and is movable into a variety of positions and configurations for adapting the present equipment to a wide variety of exercises involving different positioning of the body of the user.

The body support 84 is movable along the upper rail 86 of frame section 83 to desired horizontal spacings from stanchions 36. A locking device 87 is provided in the form of a removable pin selectably engageable through an opening in the lower portion of body support 84 and a series of horizontally spaced openings 88 formed along rail 86.

The body support 84 here comprises a horizontal seat 89 and a seat back 91 pivotably connected at 92 to the seat 89 for adjustment of the angle of the seat back relative to the seat. The upper end of seat back 91 is provided with a locking device 93 in the form of a removable pin selectively engageable through an opening in a member 94 secured to the upper end of the seat back and a vertically spaced series of perforations 96 formed in an upstanding frame member 97. This may be seen in FIG. 1 of the drawings, seat back 91 is relatively long as compared to seat 89 so that seat back 91 may be used as an inclined bench when in its lowered positions.

As a feature of the present invention, the frame 81 may be folded up to conserve space when not in use. This is accomplished by forming frame sections 82 and 83 separately and pivoting them together at 98 so that normally horizontally extending section 83 can swing upwardly to lie against vertically extending section 82.

As may be seen in FIGS. 1 and 2 of the drawings, counterbalance means 99 is carried on the frame 81 and connected to the carriages 37 for facilitating the vertical movement of the carriages and the arms they support on the upright stanchions 36. The counterbalance means 99 for each arm and carriage assembly includes a loop formed from an elongated flexible member 101 entrained over pulleys 102, 103, 104 and 106 at the upper and lower portions of the vertical frame section 82. The carriages 37 are attached to the flexible member 101 at one side of the loop and a counter weight 107 is attached to the other side of the loop.

In accordance with the present invention and as a valuable feature thereof, means 108 is provided for varying resistance to pulling of the cable 49 from the arm means 13 in varying amounts as more of the cable is pulled from the arm means. This variable resistance is here provided by a device interposed in the cable system between the carriage 37 and the weights 46.

The variable resistance device 108 includes a first spool 109 windingly receiving the end of cable 51 remote from carriage 37, and a second spool 111 windingly receiving the end of a section of cable 112 having its other end connected to the weights 46. Cable 51 passes downwardly from carriage 37 over pulley 113 to the spool 109, and cable 112 passes upwardly from spool 111 over pulleys 114 and 115, located at the upper end of frame section 82, and thence downwardly to connect with weights 46.

Spool 109 is of even diameter over its axial length, while spool 111 is of conical configuration, having a spiral cable receiving groove 116 into which the end of cable 112 is wound.

Spools 111 and 109 are both secured for joint rotation to a jackshaft 117, which is journalled in a support member 118 mounted on the bottom of frame section 82.

As handle means 11 is pulled, movement of cable 49 from the arm means 13 rotates drum 59. Normally engaged clutch means 64 connects drum 59 to jackshaft 53, thus imparting the described rotation through the jackshaft 53 to the drum 52 so as to wind cable 51 thereon.

This causes cable 51 to be pulled from spool 109, imparting rotation thereto. This rotation is transmitted through jackshaft 117 to spool 111, causing cable 112 to be wound onto spool 111 in the spiral groove 116.

The described movement of cable 112 takes place against the pull of gravity exerted on the weights 46 connected to cable 112.

From the foregoing, it will be seen that the variable exercise apparatus of the present invention provides an extremely versatile piece of equipment adapted for use in performing an extensive selection of exercises in a variety of bodily positions and in varying locations and resistances.

What is claimed is:

1. An exercise apparatus comprising a frame having a pair of spaced upright stanchions, a carriage supported by each of said stanchions for substantially vertical positioning, a telescoping arm carried on each of said carriages for movement therewith and having an end pivotably secured thereto, a cable running along each of said arms, pulley means on said arms supporting said cables for longitudinal movement relative to said arms, a manually engageable handle on the end of each of said cables adjacent to the distal end of the associated one of said arms, and weight means on the other end of said cables for resisting pulling of said cables toward said distal end of said arms.

2. An exercise apparatus as claimed in claim 1 and wherein each of said weight means comprises a plurality of individual weights, and means for selectively securing a desired number of said individual weights to said cable.

3. An exercise apparatus as claimed in claim 1 and wherein a seat is mounted on said frame between and below said carriages.

4. An exercise apparatus as claimed in claim 3 and wherein said frame has an upright portion providing said stanchions, and a horizontal portion supporting said seat.

5. An exercise apparatus as claimed in claim 4 and wherein said seat is adjustably positionable along said horizontal portion of said frame for varying the spacing between said seat and said stanchions.

6. An exercise apparatus as claimed in claim 5 and wherein a seat back is supported between said seat and said upright portion of said frame whereby adjustment of said spacing between said seat and said stanchions adjusts the tilt of said seat back accordingly.

7. An exercise apparatus as claimed in claim 3 and wherein a seat back is provided at said seat, and said seat back is formed for tilting adjustment.

8. An exercise apparatus as claimed in claim 3 and wherein said frame is free standing, and said upright and horizontal portions are hinged together for holding the frame for storage.

9. An exercise apparatus as claimed in claim 1 and wherein locking means is provided for securing said arms in a plurality of desired angular positions relative to said carriages, said locking means comprising, a first member secured to each of said arms at said end pivotally secured to said carriage, a second member secured to each of said carriages, said first and second members being formed with a plurality of openings sequentially registerable upon pivotal movement of said arms, and a pin removably engageable in aligned openings in said first and second members.

10. An exercise apparatus as claimed in claim 1 and wherein cable length adjusting means is provided for compensating for said positioning of said carriages, said last named means comprising a first drum windingly receiving the end of the section of cable having its other end attached to said handle, a second drum windingly receiving the end of the section of cable having its other end operatively connected to said weight means, a shaft supporting said first and second drums for independent coaxial rotation with said first drum secured to said shaft and said second drum journalled thereon, normally engaged clutch means having a connection to said first and second drums, a control device for selectively disengaging said clutch means, and spring means biased to rotate said shaft in a direction to wind said first named secton of cable on said first drum.

11. An exercise apparatus as claimed in claim 10 and wherein said clutch means is a manually operable sprag clutch.

12. An exercise apparatus as claimed in claim 1 and wherein counterbalance means is provided on said frame and is connected to said carriages for facilitating said vertical positioning of said carriages.

13. An exercise apparatus as claimed in claim 12 and wherein said variable resistance is provided by a device interposed in each of said cables between said carriages and said resistance means and operable to impose increasing resistance to pulling of said cables along said arms as they are being pulled, said device comprising a first spool windingly receiving the end of the section of cable having its other end operatively connected to said handle, a second spool windingly receiving the end of the section of cable having its other end connected to said weight means, a shaft carrying said first and second spools for joint coaxial rotation, and said second spool being of conical configuration having a spiral cable receiving groove.

14. An exercise apparatus as claimed in claim 1 and wherein variable resistance means is interposed in each of said cables between said carriages and said weight means for imposing increasing resistance to pulling of said cables in the direction of said handles, said variable resistance means comprising a first spool windingly receiving the end of the section of cable having its other end operatively connected to said handle, a second spool windingly receiving the end of the section of cable having its other end connected to said weight means, a shaft carrying said first and second spools for joint coaxial rotation, and said second spool being of conical configuration having a spiral cable receiving groove.

15. An exercise apparatus as claimed in claim 1 and wherein said pulley means includes a pair of egress pulleys at the distal end of each of said arms mounted on a supporting pulley block, and a tubular member mounted on said distal end of each of said arms rotatably supporting said pulley block and having said cable passing therethrough whereby said egress pulley block automatically rotates to operative position upon pulling of said cable from said arm.

16. An exercise apparatus, comprising manually engageable handle means, cable means connected to said handle means, arm means supporting said cable means whereby pulling on said handle means draws said cable means from said arm means, resistance means operatively connected to said cable means and formed for resisting pulling of said cable means from said arm means, support means carrying said arm means for relative movement and for adjusting the positions of said cable means and said handle means relative to said support means, locking means on said arm means and said support means formed for releasably securing said arm means in the desired position, said arm means having an end pivoted on each other for swinging lateral displacement of the distal end of said arm means to desired positions, said locking means being formed for releaseably securing said arm means against further lateral displacement.

17. An exercise apparatus as claimed in claim 16 and wherein said arm means is extendable and retractable in length.

18. An exercise apparatus as claimed in claim 16 and wherein said arm means comprises telescoping sections.

19. An exercise apparatus as claimed in claim 16 and wherein said arm means comprises a pair of arms carried on said support means in horizontally spaced relation.

20. An exercise apparatus, comprising manually engageable handle means, cable means connected to said handle means, arm means supporting said cable means whereby pulling on said handle means draws said cable means from said arm means, resistance means operatively connected to said cable means and formed for resisting pulling of said cable means from said arm means, support means carrying said arm means for relative movement and for adjusting the positions of said cable means and said handle means relative to each other, said arm means being moveable vertically on said support means for selective adjustment of the height of said arm means, height control means formed for releaseably securing said arm means at desired heights along said support means, said support means being formed with an upright stanchion, and a carriage supporting said arm means and moveable vertically along said stanchion, said arm means having an inner end pivoted on said carriage for swinging lateral displacement of the distal end of said arm means to desired positions.

21. An exercise apparatus, comprising a pair of manually engageable handle means, cable means connected to said handle means, arm means supporting said cable means whereby pulling on said handle means draws said cable means from said arm means, resistance means operatively connected to said cable means and formed for resisting pulling of said cable means from said arm means, support means carrying said arm means for relative movement for adjusting the position of said cable means and said hand means relative to said support means, locking means on said arm means and said support means formed for releasably securing said arm means in the desired position, said arm means having an end pivoted on said support means for swinging lateral displacement of distal end of said arm means to desired positions, said locking means being formed for releasably securing said arm means against further lateral displacement, said locking means comprising first and second members secured to said arm means and said support means with one of said members having a plurality of circumferentially spaced openings around the center of pivot of said arm means and the other of said members having an opening selectively registrable with said first named openings, and a removable pin engageable in registered openings.

22. An exercise apparatus, comprising manually engageable handle means, cable means connected to said handle means, arm means supporting said cable means whereby pulling on said handle means draws said cable means from said arm means, resistance means operatively connected to said cable means means and formed for resisting pulling of said cable means from said arm means, support means carrying said arm means for relative movement for adjusting the position of said cable means and said handle means relative to said support means, said arm means being movable vertically with said support means for selective adjustment of the height of said arm means, height control means formed for releasably securing said arm means at desired heights along said support means, said support means being formed with an upright stanchion, a carriage means supporting said arm means and movable vertically along said stanchion, said arm means having an inner end pivoted on said carriage for swinging lateral displacement of the distal end of said arm means to desired positions, locking means on said arm means and said carriage for releasably securing said arm means in a desired position, said arm means being extendable and retractable so as to provide a desired length thereof and comprising telescoping sections having registrable openings formed longitudinally along said telescoping sections, a pin selectively engageable in registered openings for locking said arm means in desired extended and retracted positions, pulley means for supporting said cable means carried at said pivoted end and on said distal end of said arm means, said pulley means on said distal end on said arm means being formed for movement to any desired position within the volumetric area between concentric cylindrical sections defined by the arcs described by said distal end of said arms when swung with such arm means in fully extended and fully retracted condition at all heights of said carriage along said stanchion.

23. An exercise apparatus, comprising manually engageable handle means, cable means connected to said handle means, arm means supporting said cable means whereby pulling on said handle means draws said cable means from said arm means, resistance means operatively connected to said cable means and formed for resisting pulling of said cable means from each of arm means, support means carrying said arm means for relative movement for adjusting the position of said cable means and said handle means relative to said support means, locking means on said arm means and said support means formed for releasably securing said arm means in a desired position, said arm means having an end pivoted on said support means for swinging lateral displacement of the distal end of said arm means to desired positions, said locking means being formed for releasably securing said arm means against lateral displacement, said resistance means comprising a weight of adjustable mass resisting of pulling of said cable means from said arms in accordance with the influence of gravity, said apparatus further comprising cable length adjustment means formed for readjusting the effective length of said cable means upon said vertical movement of said arm means whereby said handle means is maintained at a normal position a desired distance from said arm means.

24. An exercise apparatus, comprising a pair of manually engageable handle means, cable means connected to said handle means, first and second horizontally spaced arm means supporting said cable means whereby pulling on said handle means draws said cable means from each of said arm means, resistance means operatively connected to said cable means and formed for resistance pulling of said cable means from said arm means, support means carrying said arm means for vertical movement and for independently adjusting the heights of said cable means and said handle means relative to each other, said first and second arm means each having an end pivoted on said support means for swinging lateral displacement of the distal end of each of said arm means to desired positions, locking means on said arm means and said support means formed for releasably securing said arm means at the desired heights and lateral positions, each of said arm means being formed to be extendable and retractable in length, and arm length determining means mounted on each of said arm means and formed for selectively locking each of said arm means in desired extended and retracted positions.

25. An exercise apparatus as claimed in claim 24 and wherein said first and second means each comprises telescoping sections, and wherein said arm length determining means comprises a pin removably engageable in registerable openings formed longitudinally along said telescoping sections.

26. An exercise apparatus as claimed in claim 25 and wherein pulley means for supporting said cable means is carried on both said pivoted end and said distal end of said arm means.

27. An exercise apparatus as claimed in claim 26 and wherein said pulley means on said distal end of said arm means is movable to any desired position within the area between the concentric arcs described by said distal end of said arm means horizontally with said arm means fully extended and fully retracted.

28. An exercise apparatus, comprising a supporting frame, a pair of horizontally spaced arm means pivotably supported by said frame for independent swinging movement in a generally horizontal plane, lock means on said frame and said arm means formed for releasably locking said arm means in any one of a plurality of angular positions, cable means passing along said arm means to the distal ends thereof, handle means at the end of said cable means adjacent to said distal ends of said arm means, resistance means connected to said cable means and formed for resisting pulling of said cable means from the distal ends of said arm means, said frame having a vertically extending section carrying said arm means and a horizontally extending section, a body support means movable along said horizontally extending section of said frame to desired positions, and another lock means formed for securing said body support to said frame at the desired position.

29. An exercise apparatus as claimed in claim 28 and wherein said another lock means comprises a pin removably mounted in aligned openings formed in said body support and along said horizontally extending section of said frame.

30. An exercise apparatus, comprising a supporting frame, a pair of horizontally spaced arms pivotably supported by said frame for independent swinging movement in a generally horizontal plane, lock means on said frame and said arms formed for releasably locking said arms in any one of a plurality of angular positions, cable means passing along said arms to the distal ends thereof, handle means at one end of said cable means adjacent to said distal ends of said arms, resistance means connected to said cable means and formed for resisting pulling of said cable means from the distal ends of said arms, carriage means mounted on said frame for varying the vertical position of said arms, said arms being individually mounted on said carriage means, and counterbalance means carried on said frame and connected to said carriages for facilitating the vertical movement of said carriages.

31. An exercise apparatus as described in claim 30 and wherein said counterbalance means comprises a loop formed from an elongated flexible member entrained over pulleys at the upper and lower portions of said frame, said carriage means being vertically slidable on said frame and being attached to said loop for movement therewith, and a counterweight secured to said loop on the side thereof opposite to the side connected to said carriage means.

32. An exercise apparatus, comprising manually engageable handle means including a plurality of handles, cable means including a plurality of handles connected to said handle means, arm means supporting said cable means whereby pulling on said handle means draws said cable means from said arm means, resistance means operatively connected to said cable means and formed for resisting pulling of said cable means from said arm means, support means carrying said arm means for relative vertical and lateral movement for adjusting the position of said cable means and said handle means relative to said support means, means for releasably securing said arm means in the desired position, said resistance means being formed to provide variable resistance to pulling of said cable means from said arm means, said resistance means including a rotatable means interposed along the path of said cable means and operable to cause increasing resistance to pulling of two of said plurality of cables along said arms, said rotatable means comprising a first spool windingly received on one end of one cable of said plurality of cables, the opposite end of said one cable of said plurality of cables being operatively connected to one of said handles, weight means providing resistance to pulling of said handles, a second spool windingly receiving one end of another of said plurality of cables having its opposite end connected to said weight means, a shaft carrying said first and second spools for joint coaxial rotation, and said second spool being of conical configuration having a spiral cable receiving groove.

33. An exercise apparatus, comprising a pair of manually engageable handle means, cable means connected to said handle means, first and second horizontally spaced arm means supporting said cable means whereby pulling on said handle means draws said cable means from each of said arm means, resistance means operatively connected to said cable means and formed for resistance pulling of said cable means from said arm means, support means carrying said arm means for vertical movement and for independently adjusting the heights of said cable means relative to each other and to said support means, said first and second arms means each having an end pivoted on said support means for swinging lateral displacement of the distal end of each of said arm means to desired positions, locking means on said arm means and said support means formed for releasably securing said arm means at the desired heights and lateral positions, each of said arm means being formed to be extendable and retractable in length, and said first and second arm means each being formed of telescoping sections.

34. An exercise apparatus, comprising a pair of manually engageable handle means, cable means connected to said handle means, first and second horizontally spaced arm means supporting said cable means whereby pulling on said handle means draws said cable means from each of said arm means, resistance means operatively connected to said cable means and formed for resistance pulling of said cable means from said arm means, support means carrying said arm means for vertical movement and for independently adjusting the heights of said cable means and said handle means relative to each other, said first and second arms means each having an end pivoted on said support means for swinging lateral displacement of the distal end of each of said arm means to desired positions, said first and second arm means each being extendable and retractable in length and having an end pivoted on said support means for swinging lateral displacement of the distal end of each of said arm means to desired positions, and locking means on said arm means and on said support means formed for releasably securing said arm means at the desired height and lateral positions.

* * * * *